US009312640B2

(12) United States Patent
Lange et al.

(10) Patent No.: US 9,312,640 B2
(45) Date of Patent: Apr. 12, 2016

(54) SHIELDED CONNECTOR ASSEMBLY

(75) Inventors: Ludwig Lange, Nuland (NL); Winnie Heyvaert, Woostwezel (BE); Thierry Goossens, Herdersem-Aalst (BE); Robert Van Den Heuvel, Appeltern (NL)

(73) Assignee: FCI, Guyancourt (FR)

( * ) Notice: Subject to any disclaimer, the term of this patent is extended or adjusted under 35 U.S.C. 154(b) by 67 days.

(21) Appl. No.: 13/993,338

(22) PCT Filed: Dec. 13, 2011

(86) PCT No.: PCT/IB2011/003257

§ 371 (c)(1),
(2), (4) Date: Sep. 30, 2013

(87) PCT Pub. No.: WO2012/080841

PCT Pub. Date: Jun. 21, 2012

(65) Prior Publication Data

US 2014/0057492 A1 Feb. 27, 2014

(30) Foreign Application Priority Data

Dec. 13, 2010 (WO) ..... PCT/IB2010/003416

(51) Int. Cl.

| | |
|---|---|
| ***H01R 13/6586*** | (2011.01) |
| ***H01R 13/6461*** | (2011.01) |
| ***H01R 13/6585*** | (2011.01) |
| ***H01R 12/72*** | (2011.01) |
| ***H01R 13/6587*** | (2011.01) |
| *H01R 13/514* | (2006.01) |
| *H01R 12/58* | (2011.01) |

(52) U.S. Cl.

CPC ..... *H01R 13/6585* (2013.01); *H01R 12/724* (2013.01); *H01R 12/727* (2013.01); *H01R 13/6587* (2013.01); *H01R 12/585* (2013.01)

(58) Field of Classification Search

CPC .. H01R 12/716; H01R 12/724; H01R 13/514; H01R 13/6461; H01R 13/6586; H01R 12/585

USPC ..... 439/541.5, 607.02, 607.39, 607.47, 439/701, 607.05–607.12

See application file for complete search history.

(56) References Cited

U.S. PATENT DOCUMENTS

| | | | | |
|---|---|---|---|---|
| 5,114,355 | A | 5/1992 | Kimmel et al. | 439/101 |
| 5,620,340 | A | 4/1997 | Andrews | 439/608 |
| 5,904,594 | A * | 5/1999 | Longueville et al. | 439/607.1 |

(Continued)

FOREIGN PATENT DOCUMENTS

| | | |
|---|---|---|
| WO | WO 96/19850 | 6/1996 |
| WO | WO 02/03502 A2 | 1/2002 |

*Primary Examiner* — Amy Cohen Johnson
*Assistant Examiner* — Matthew T Dzierzynski
(74) *Attorney, Agent, or Firm* — Harrington & Smith

(57) ABSTRACT

An assembly is disclosed herein, including a connector and a carrier for carrying the connector. The connector includes a plurality of terminals having terminal contacts, a first shield at least partially surrounding at least one first terminal and having a first shield contact and a second shield at least partially surrounding at least one second terminal and having a second shield contact. The carrier includes a plurality of signal conductors, e.g. being a circuit board or a connector body. The carrier also includes a plurality of, advantageously substantially identical, contact sites. The terminal contacts are contacted to a number of the contact sites of the carrier, and the first and second shield contacts are arranged adjacent each other so that they together fit and are contacted to one contact site of the carrier.

15 Claims, 3 Drawing Sheets

(56) References Cited

U.S. PATENT DOCUMENTS

| | | | | |
|---|---|---|---|---|
| 6,899,566 | B2 | 5/2005 | Kline et al. | 439/608 |
| 2008/0026638 | A1 | 1/2008 | Cohen et al. | 439/608 |
| 2012/0214343 | A1* | 8/2012 | Buck et al. | 439/607.05 |
| 2013/0109232 | A1* | 5/2013 | Paniaqua | 439/607.07 |
| 2013/0323978 | A1 | 12/2013 | Ho | |

* cited by examiner

SHIELDED CONNECTOR ASSEMBLY

TECHNICAL FIELD

The present disclosure relates to shielded connectors, in particular shielded electrical connectors.

BACKGROUND

Shielded board connectors are known in the art. In connectors comprising plural signal terminals, shields are used to isolate signal terminals from each other and/or reduce cross talk between nearby signal terminals. Some connectors comprise isolation of pairs of terminals forming differential signal pairs. The shields are preferably conductive and connected to a reference voltage or ground.

For example, U.S. Pat. No. 6,899,566 discloses an electrical board connector assembly having a header connector and a receptacle connector matable with one another. An array of signal contacts are secured to the header connector and arranged as differential contact pairs. An array of L-shaped ground shields are secured to the header connector. Each ground shield is arranged to partially surround and isolate a corresponding differential contact pair from adjacent differential contact pairs. The L-shaped ground shields and contact spacing cooperate to electromagnetically couple signal contacts in a differential contact pair more closely to one another than to signal contacts in adjacent differential contact pairs.

Such an electrical connector assembly has different shielding geometries within the header connector and between the header connector and the receptacle connector, which adversely affects impedance and signal integrity.

Further, U.S. Pat. No. 5,620,340 discloses a board connector comprising a body of electrically insulating material having contact holes each provided with an electrically conductive contact element and arranged in at least two columns and at least two rows. Shielding elements of electrically conductive plate material being disposed in the body are provided. Each shielding element is shaped and arranged so that neighbouring contact elements are always entirely shielded from each other by parts of the shielding elements. The shielding elements are square wave shaped and are each arranged within one column in such a way that an open portion of each of the square wave shaped shielding elements is not adjacent to an open portion of a neighbouring square wave shaped shielding element.

This connector is designed for coaxial signal lines. Also this connector provides different shielding geometries within the connector. Further, the layout of the connection terminals (the "footprint") on both sides of the connector is different, which may complicate accurate impedance matching of signals.

In view of the continuous drive to higher signal frequencies and smaller devices, improved shielded board connectors are desired without increasing the complexity of the connector design.

SUMMARY

An assembly is disclosed herein, comprising a connector and a carrier for carrying the connector. The connector comprises a plurality of terminals having terminal contacts, a first shield at least partially surrounding at least one first terminal and having a first shield contact and a second shield at least partially surrounding at least one second terminal and having a second shield contact. The carrier comprises a plurality of signal conductors, e.g. being a circuit board or a connector body. The carrier also comprises a plurality of, advantageously substantially identical, contact sites. The terminal contacts are contacted to a number of the contact sites of the carrier, and the first and second shield contacts are arranged adjacent each other so that they together fit and are contacted to one contact site of the carrier.

Thus, the first and second shields share one contact site obviating (space for) a separate second contact site, thus allowing to increase contact density in the assembly. Further, the voltages of the first and second shields are now commonly defined. Thus, voltage fluctuations between these shields and associated noise on signals are reduced or even prevented.

The contact sites of the carrier may be solder pads and the like, and the first and second shield contacts may be solder contacts or BGA-type contacts, possibly being provided with a common fusible element such as a solder ball. However, it is considered advantageous if at least the common contact site is a contact hole, a through hole or a via hole, and at least the first and second shield contacts are insertion-type contacts, as specified in claim 2. The insertion type contacts may be press-fit contacts, eye-of-the-needle-type contacts, pin-type contacts etc. With such assembly, true positioning of (the shields of) the connector and the stability of the assembly are improved. Further, any potential mechanical stress on or by the common contact of the first and second shield contacts may be absorbed by the carrier. This further prevents accidental (increase of) separation of the first and second shield contact in case of soldering and/or otherwise heating of the connector and/or the carrier.

The assembly of claim 3 facilitates optimising contact layout in both connector and carrier as well as conductor tracing on and/or in the carrier. Further, it facilitates maintaining a specific contact- and terminal arrangement in the connector from a mating side to a carrier side, thus facilitating preventing impedance variations and associated potential signal degradation.

The assembly of claim 4 provides shielding for sets of first and second terminals, in particular for pairs of terminals for differential signal transmission.

The shields may generally have a substantial L-shape, or surround the terminal substantially all around, e.g. square, C-shaped or otherwise substantially fully surrounding a terminal. However, the assembly of claim 5 allowing a compact configuration with shielding on three sides of the terminal(s) may be advantageous. Such shielding generally is sufficient for shielding high signal frequencies while requiring little space. Further, a U-shaped shield is preferred for differential signalling since distances between each terminal of a differential signal pair to the shield may be equal and constant and open areas in the shield are prevented, e.g. in contrast to the shielding arrangement of the header of U.S. Pat. No. 6,899,566 discussed above.

Moreover, in a U-shaped shield having a back portion and two generally substantially parallel leg portions extending opposite each other from the back portion, the length of the leg portions from the back portion (substantially determining the "depth" of the U-shape) may be selected to be substantially equal or different and be independent from the separation of the shield to an adjacent, possibly U-shaped, shield. This allows further optimisation of the shielding arrangement.

The assembly of claim 6 allows defining the voltage of each of the first and second shield both with respect to each other and to a mating connector on at least two sides, further reducing or preventing voltage fluctuations between the shields and associated noise. In such assembly, the first and second shields may function as a ground terminal, so that a further ground terminal may therefore be obviated. The arrangement of the contacts, both terminal contacts and shield contacts, on the mating side and the carrier sides may be substantially equal with respect to the configurations, shapes and/or mutual separations. This may improve constant impedance along the connector.

In the assembly of claim 7 the connector is modular, increasing flexibility in providing a particular terminal arrangement. Furthermore, manufacturing of the connector may be facilitated and/or true position of the contacts may be improved.

With the assembly of claim 8 voltage of the shields may be further defined and shielding may be improved. In addition, a predictable contact arrangement is provided, facilitating exchange of the carrier or the connector for another carrier, connector or further object. Also, design and modelling of conductor tracing is facilitated.

Flexibility of use and adaptation of the terminal arrangement (pinout) is further increased with the assembly of claim 9.

The connector may have any shape, but in the case of a an angled connection, e.g. mother card to daughter card, an assembly according to claim 10 may be advantageous, wherein adjacent columns of bent and/or curved terminals are shielded.

In an aspect, an assembly is disclosed comprising a connector and a carrier for carrying the connector. The connector comprises a plurality of terminals having terminal contacts, a first shield at least partially surrounding at least one first terminal and having a first shield contact and a second shield at least partially surrounding at least one second terminal and having a second shield contact. The carrier comprises a plurality of signal conductors and a plurality of contact holes. The first and second shield contacts are arranged adjacent each other so that they together fit and contact one common contact hole of the carrier. The carrier may be a circuit board.

With such assembly, a shielded connector may be provided using relatively little volume and carrier space. Such assembly may further be manufactured relatively cost-efficient.

In another aspect, an assembly comprising a connector and a carrier for carrying the connector is disclosed. The connector comprises a plurality of lead frame assemblies comprising a dielectric body holding a plurality of terminals having terminal contacts, at least one lead frame assembly comprising a first shield and a second shield. The first shield at least partially surrounds at least a pair of terminals and has a first shield contact and the second shield at least partially surrounds at least a pair of terminals and has a second shield contact. The carrier comprises a plurality of signal conductors and a plurality of substantially identical contact holes arranged adjacent each other in an array comprising at least one of a column and a row. The first and second shields are arranged adjacent each other so that the first and second shield contacts together fit and contact one common contact hole of the carrier.

Such assembly allows great flexibility in assembling the connector and the carrier to provide a desired connector layout, which may occupy a relatively small volume.

A connector for use in the assembly comprising the features of any connector defined and described above provides a valuable addition to the art.

Such connector may comprise one or more lead frame assemblies, which may comprise a plurality of shields. Such lead frames may be manufactured and sold separately. Suitable lead frames are defined in claims 14 and 15.

The assembly, the connector and/or a lead frame may comprise more than two shields, wherein adjacent shields have shield contacts which are pairwise arranged adjacent each other so that they together (are configured to) fit and (configured to be) contacted to one common contact site of the carrier, just as described for the first and second shields and shield contacts above.

BRIEF DESCRIPTION OF THE DRAWINGS

The above-described aspects will hereafter be more explained with further details and benefits with reference to the drawings showing an embodiment of the invention by way of example.

DETAILED DESCRIPTION OF EMBODIMENTS

Figure 2:
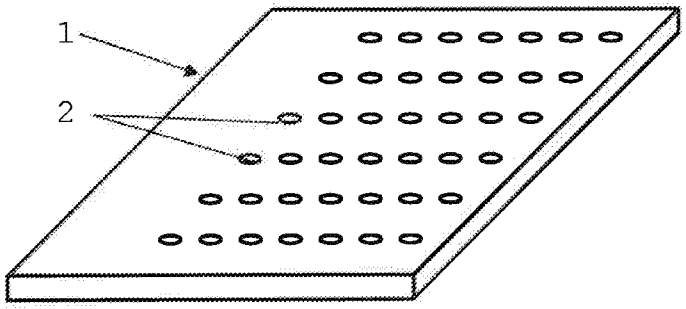
FIG. 2 is a schematic perspective view of a circuit board.

It is noted that the drawings are schematic, not necessarily to scale and that details that are not required for understanding the present invention may have been omitted. The terms "upward", "downward", "below", "above", and the like relate to the embodiments as oriented in the drawings, unless otherwise specified. Further, elements that are at least substantially identical or that perform an at least substantially identical function are denoted by the same numeral.

Figure 1:
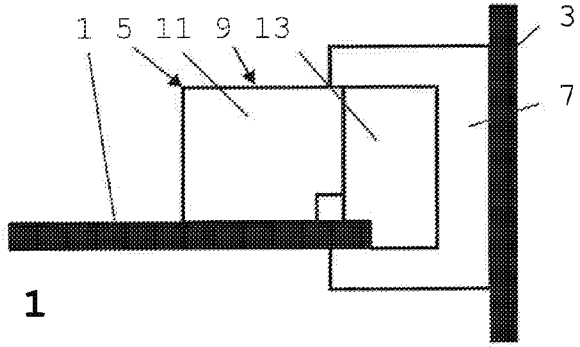
FIG. 1 is a schematic side view of an assembly of two circuit boards interconnected with a mating connector assembly.
Figure 3:
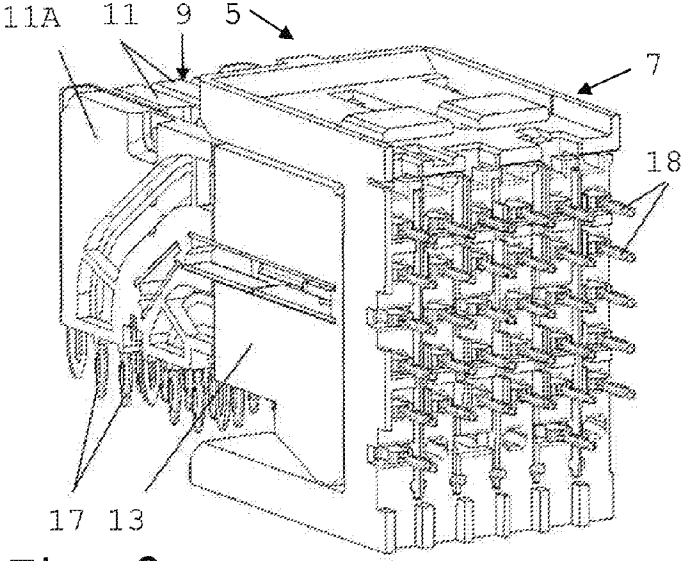
FIG. 3 is a perspective view of a connector assembly.

FIG. 1 shows an assembly of two circuit boards 1, 3 interconnected with a mating connector assembly 5 in turn comprising a header connector 7 and a receptacle connector 9. FIG. 2 schematically indicates a generally known circuit board 1 having a plurality of substantially identical contact sites, here in the form of contact holes 2, to which conductors (not shown) are or may be connected. In the shown circuit board the contact holes 2 are arranged substantially equidistantly in columns, which columns are arranged substantially equidistantly in a row. The circuit board 3 may be different or substantially similar to the circuit 1. FIG. 3 shows the connector assembly 5 in more detail, the receptacle connector 9 is shown in more detail in FIG. 4.

The receptacle connector 9 comprises a plurality of insert molded lead frame assemblies 11 (IMLAs) mounted in a housing 13. In the receptacle connector 9 a number of IMLAs 11, identified with reference numeral 11A, is shielded as will be discussed below in more detail. Within the scope of this disclosure a receptacle connector may comprise more, less and/or differently formed IMLAs. In the embodiment shown, the receptacle connector 9 is an angled connector, in particular a right-angle connector, for connecting circuit boards 1 and 3 substantially perpendicular to each other.

Figure 9:
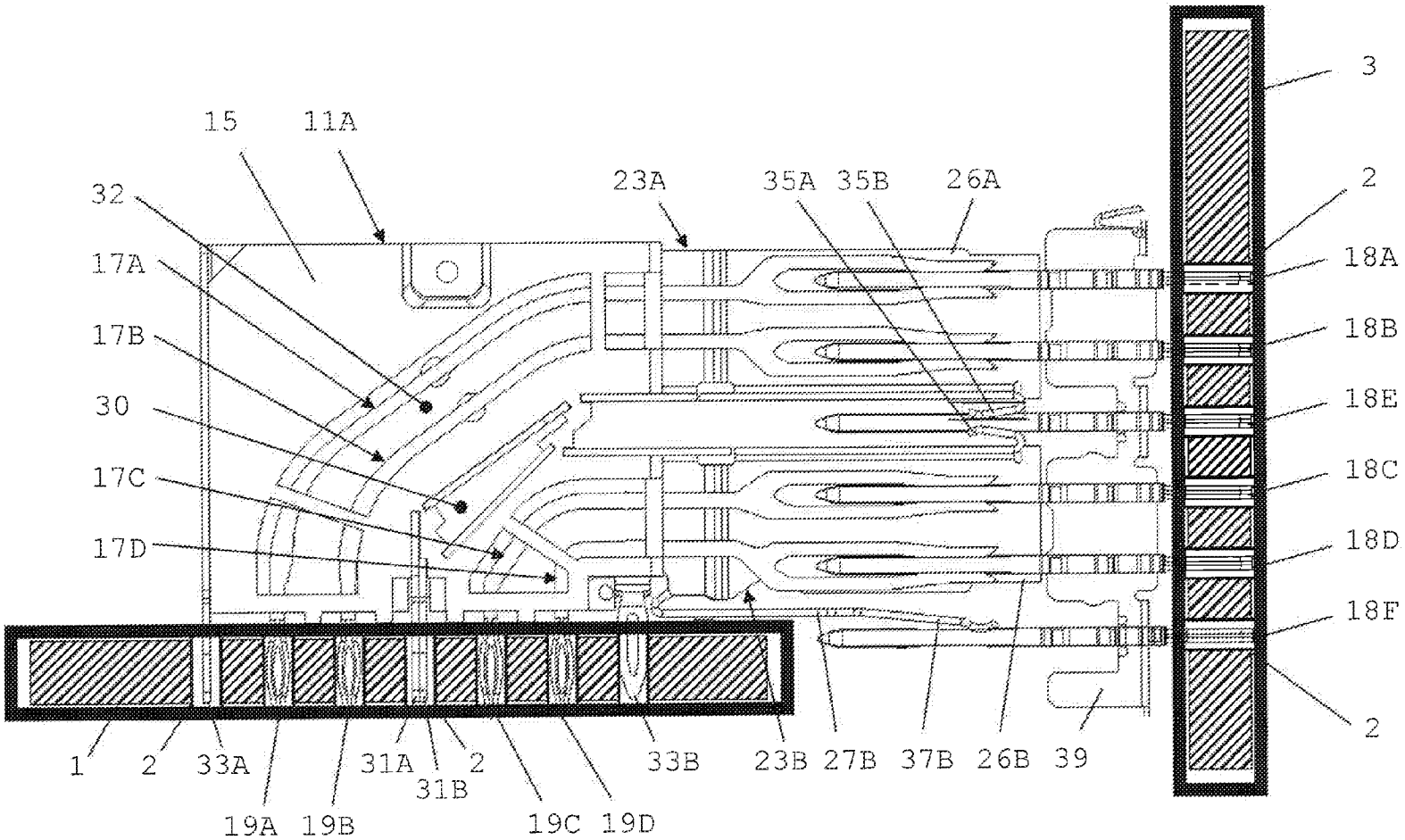
FIG. 9 is a partial cross section view of the connector assembly of FIG. 3 showing a side view of the shielded lead frame assembly of FIGS. 5-6, together with terminals and a shield of the mating connector and circuit boards.

FIG. 9 is a side view of a shielded IMLA 11A and further showing corresponding conductive portions of the header connector 7, together with the circuit boards 1, 3.

Figure 6:
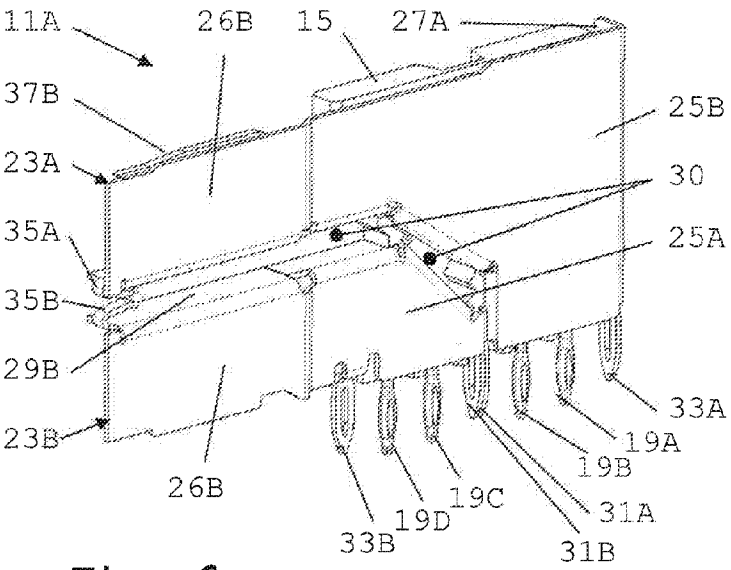
FIGS. 5 and 6 are perspective views of a shielded lead frame assembly of the connector of FIG. 4.
Figure 5:
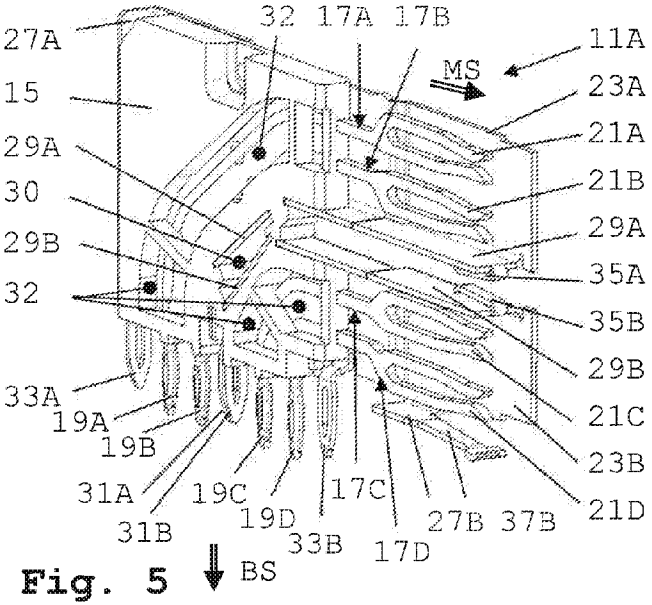
Figure 8:
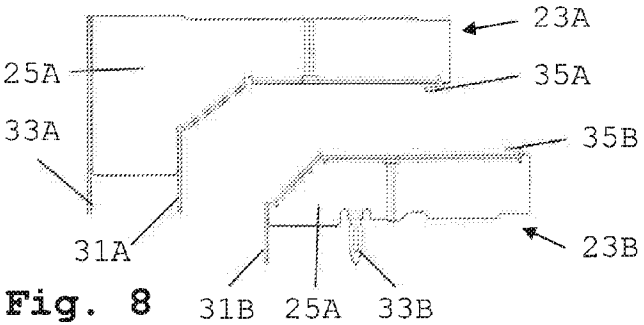
FIGS. 7 and 8 are side views of the shields of the shielded lead frame assembly of FIGS. 5-6.

Referring also in more detail to FIGS. 5, 6 and 9, each IMLA 11 comprises a dielectric body 15 holding one or more terminals 17 extending between a first contact 19 on a board side BS for mounting to a circuit board 1 and a second contact on a mating side MS for mating to a counterconnector, here the header connector 7. In the embodiment shown, IMLAs 11 comprise five terminals 17 and shielded IMLAs 11A comprise four terminals, individually referred to as 17A-17D. Correspondingly, the header connector comprises header terminals 18 for contacting the receptacle terminals 17 on a mating side and for contacting the circuit board 3 on a board side (FIGS. 1, 3, 9). The IMLAs 11 are configured for relatively low signal frequencies. The shielded IMLAs 11A are configured for relatively high signal frequencies, in particular with differential signal transmission.

Figure 7:
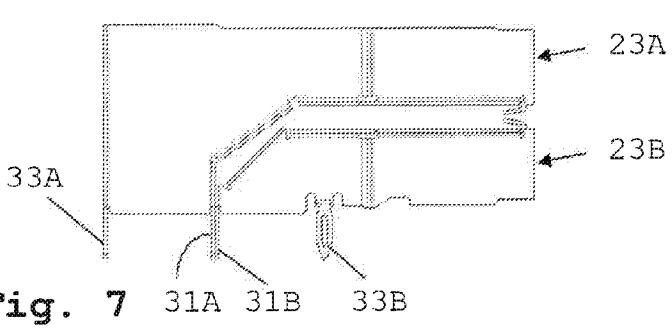

The shielded IMLAs 11A further comprise a first shield 23A and a second shield 23B, shown in more detail in FIGS. 6-7. The first and second shields 23A, 23B each comprise a shield body portion 25A, 25B, which here is substantially continuous and plane but which may have some structure, e.g. an embossment. The shields 23A, 23B further comprise a front portion 26A, 26B, offset from but substantially parallel to the shield body portion 25A, 25B. The shields 23A, 23B also comprise outer side wall portions 27A, 27B and inner side wall portions 29A, 29B arranged, e.g. by bending, at an angle to the main shield body 25A, 25B, here being substantially perpendicular to the shield body portions 25A, 25B. In the shielded IMLA 11A, due to the shield body portions 25A, 25B and the side wall portions 27A-29B, the first and second shields 23A, 23B each surround a portion of the dielectric body 15 and a pair of terminals 17A, 17B and 17C, 17D, respectively, by being adjacent the terminals on at least two sides and in some portions on three sides, thus forming a U-shape.

In the IMLA 11A, (the shield body portions 25A, 25B of) the first and second shields 23A, 23B are arranged adjacent and generally parallel each other, forming a substantially plane shield assembly in radial direction with respect to the angle of curvature of the connector 9. In order to receive and hold the shields 23A, 23B, the insulating body 15 of the IMLA 11A comprises matching structures, here a plurality of recesses which further form one or more optional windows 30 through the insulating body 15. Due to the inner side wall portions 29A, 29B of the conductive shields 23A, 23B such windows 30 and/or their exact shape hardly affect the impedance of the terminals 17. One or more optional recesses 32 in the insulating body 15 around (one or more portions of) the terminals 17, however, do have an effect on the impedance and their shape may be determined to provide a desired impedance.

The first shield 23A comprises a first shield contact 31A and the second shield 23B comprises a second shield contact 31B. The first shield 23A further comprises a third shield contact 33A and the second shield 23B comprises a fourth shield contact 33B. The first and second shields 23A, 23B further comprise a first and second mating contact 35A, 35B, respectively, and the second shield 23B comprises an optional third mating contact 37B, a similar optional mating contact 37A on the first shield 23A is indicated in FIG. 6, but is absent in the other Figures. The first and second shield contacts 31A, 31B extend from the respective inner side walls 29A, 29B on the board side BS and the first mating contacts 35A, 35B extend from the respective inner side walls 29A, 29B on, but oriented away from, the mating side MS of the shields 23A, 23B. The third shield contact 33A extends from the outer side wall 29A, the fourth shield contact 33B extends from the main body portion 25B of the second shield 23B and the third mating contact 37B extends from the outer shield portion 27B.

In the IMLA 11A, (the main bodies 25A, 25B of) the first and second shields 23A, 23B are arranged adjacent and generally parallel each other, forming a substantially plane shield assembly in radial direction with respect to the angle of curvature of the connector 9.

Further, in the connector, here within one shielded IMLA 11A, the first and second shields 23A, 23B are arranged with a portion of the inner side wall portions 29A, 29B close to or against each other and with the first and second shield contacts 31A, 31B close to each other, advantageously abutting each other as shown in FIGS. 3-6 and 9. Thus, and in particular when abutting, the first and second shield contacts 31A, 31B may together form a combined contact which is substantially similar to the terminal contacts 19.

Figure 4:
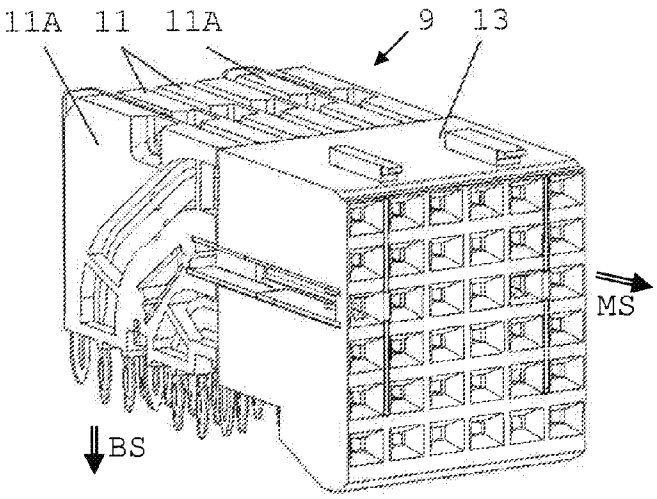
FIG. 4 is a perspective view of a connector.

In the shown embodiment all first terminal contacts 19A-19B, and the first to fourth shield contacts 31A-33B are of a substantially similar press-fit contact type for insertion into a contact hole 2 of the circuit board 1, see FIG. 9. The first and second shield contacts 31A, 31B together may take up about the same volume as one terminal contact 19(A-D) so that the first and second shield contacts 31A, 31B together may fit one common contact site, here a contact hole 2 in the circuit board 1 as shown in FIG. 9. As best seen in FIGS. 3-5, in the IMLA 11A and in the connector 5, the first contacts 19A-19B of the terminals and the first to fourth shield contacts 31A-33B are arranged in a generally straight column. Here, the first to third shield contacts 31A, 31B, 33A extend substantially perpendicular to the direction of the column, whereas the remaining contacts 19A-19D and 33B extend substantially in the direction of the column, but different arrangement should be considered within the scope of the appended claims. Along the column, the first terminal contacts 19A-19B and the first to fourth shield contacts 31A-33B are effectively arranged substantially equidistantly (as 33A, 19A, 19B, 31A and 31B together, 19C, 19D, 33B, wherein the first and second shield contacts 31A, 31B are, in a manner of speaking, "together counted as one").

On the mating side MS of the IMLA 11A, the second terminal contacts 21A-21D extend in a column substantially parallel to each other. The second terminal contacts 21A-21D here are formed as tuning fork-type contacts but other contact types are equally conceivable. The (main body 25A, 25B of the) first and second shields 23A, 23B extends adjacent and beyond the terminal contacts 21A-21D to shield the contacts. In the receptacle connector 9 the terminal contacts 21 are arranged in a substantially regular grid-like array of columns and rows.

Best seen in FIGS. 3 and 9, the header connector 7 comprises a plurality of header terminals 39, arranged in a substantially regular grid-like array corresponding to the arrangement of terminals 17 of the receptacle connector.

From FIGS. 3 and 9 is visible that within one column (corresponding to the column of one IMLA 11A) the header connector 7 comprises six header terminals 18A-18F. The header connector 7 further comprises header shields 39 of which a portion is adjacent and substantially parallel to the header terminals 18A-18F. The (front portions 26A, 26B of the) first and second shields 23A, 23B may abut or otherwise contact a header shield 39 and therewith assure equal voltages on the shields 23A, 23B, 39. From FIG. 9 it will be evident that the first to fourth receptacle terminals 17A-17D contact the first to fourth header terminals 18A-18D, suitable for transmitting signals, in particular differential signals. Both first mating shield contacts 35A, 35B contact the fifth header terminal 18E as a common contact. The sixth header terminal 18F contacts the second mating shield contact 37B. The fifth and sixth header terminals 18E, 18F and the first and second shields 23A, 23B may thus be maintained at an equal voltage. Since the first mating shield contacts 35A, 35B point away from the mating side MS of the receptacle connector 5, insertion force for mating the connectors 5, 7 may be reduced and potential misalignment is prevented.

Generally, the header terminals 18A-18F may be assigned Signal 18A—Signal 18B—Ground 18E—Signal 18C—Signal 18D—Ground 18F and the board contacts 19A-19D and 31A-33B of the receptacle connector may correspondingly be assigned Ground 33A—Signal 19A—Signal 19B—Ground 31A and 31B combined—Signal 19C—Signal 19D—Ground 33B, thus providing in a column of two shielded differential signal pairs. The separation between adjacent contact sites and contacts on the boards 1 and 3 may be substantially equal, again with the first and second shield contacts 31A, 31B "together counted as one contact" since both contacts 31A, 31B fit the same contact hole 2. When the third shield contact 33A is left out, the pinout and arrangement of contacts 19A-19D, 31A,B, 33B on the first board 1 and contacts 18A-18F on the second board 3 may be even more equal. Also, a further header contact and a further mating shield contact may be provided opposite the sixth header terminal 18F and the second mating shield contact 37B, corresponding to the third shield contact 33A but these are absent in the shown embodiment.

When the header shield 39 is at the same voltage, e.g. by being contacted by the first or second shield 23A, 23B and/or by a terminal 18E and/or 18F, all shields 23A, 23B, 39 and ground contacts 18E-18F and 31A-33B may have equal voltage, allowing to increase signal integrity to signal transmitted over signal terminals 17A-18D.

The invention is not restricted to the above described embodiments which can be varied in a number of ways within the scope of the claims. For instance, the contacts may comprise different types, e.g. solder contacts and/or Ball Grid Array contacts.

Also a header connector may comprise first and second shields having first and second shield contacts as described herein.

The connectors may be straight to form a mezzanine connector assembly.

More or less IMLAs, and/or IMLAs comprising different numbers of terminals may be provided.

Each terminal may comprise a shield, wherein the shields may have shield contacts that may be arranged to fit a common contact site.

Elements and aspects discussed for or in relation with a particular embodiment may be suitably combined with elements and aspects of other embodiments, unless explicitly stated otherwise.

The invention claimed is:

1. Assembly comprising:

a connector and a first carrier for carrying the connector, wherein the connector comprises:

a plurality of terminals having terminal contacts, a first shield at least partially surrounding at least one first terminal and having a first shield contact at a first end and a second shield contact at a second end, and a second shield at least partially surrounding at least one first terminal and having a first shield contact at a first end and a second shield contact at a second end;

wherein the first carrier comprises a plurality of signal conductors and a plurality of contact sites;

wherein the terminal contacts are contacted to a number of the contact sites of the first carrier, wherein the first shield contacts of each shield are arranged adjacent each other so that they contact each other and together fit and contact one common contact site of the first carrier, and wherein the second shield contacts of each shield are arranged adjacent each other so that they are electrically connected by a second common contact site of a second carrier.

2. Assembly according to claim 1, wherein the common contact site comprises at least one of a contact hole and a via hole, and wherein at least the first and second shield contacts are insertion-type contacts.

3. Assembly according to claim 1, wherein at least a portion of the contact sites and the common contact site are arranged adjacent each other in an array comprising at least one of a column and a row.

4. Assembly according to claim 1, wherein the first and second shields each at least partially surround a pair of first terminals and, respectively, second terminals.

5. Assembly according to claim 1, wherein at least a portion of at least one of the first and second shields is substantially U-shaped.

6. Assembly according to claim 1, wherein the connector has a carrier side and a mating side and the first and second shields extend from the carrier side towards the mating side, wherein the first and second shield contacts are arranged on the carrier side of the first and second shields, respectively, and wherein the first and second shields each comprise on the mating side a mating contact for contacting a common contact of a mating connector.

7. Assembly according to claim 1, wherein the connector comprises a plurality of lead frame assemblies comprising a dielectric body holding a plurality of terminals, at least one lead frame assembly comprising first and second shields.

8. Assembly according to claim 1, wherein in at least a portion of the connector at least one of the first and second shields comprises a further shield contact and wherein the shield contacts and the terminal contacts are arranged in a row or a column, preferably effectively at substantially equidistant positions.

9. Assembly according to claim 1, wherein the terminal contacts and the first and second shield contacts, and, if applicable, the further shield contacts, are of substantially the same contact type.

10. Assembly according to claim 1, wherein the connector is an angled connector and wherein the first and second shields are arranged adjacent each other in radial direction for shielding radially adjacent terminals.

11. Assembly comprising a connector and a first carrier for carrying the connector, wherein the connector comprises:

a plurality of terminals having terminal contacts, a first shield at least partially surrounding at least one first terminal and having a first shield contact at a first end and a second shield contact at a second end, and a second shield at least partially surrounding at least one first terminal and having a first shield contact at a first end and a second shield contact at a second end;

wherein the first carrier comprises a plurality of signal conductors and a plurality of contact holes;

wherein the first shield contacts of each shield are arranged adjacent each other so that they contact each other and together fit and contact one common contact hole of the first carrier; and wherein the second shield contacts of each shield are arranged adjacent each other so that they are electrically connected by a second common contact site of a second carrier.

12. Assembly comprising a connector and a first carrier for carrying the connector, wherein the connector comprises:

a plurality of lead frame assemblies comprising a dielectric body holding a plurality of terminals having terminal contacts, at least one lead frame assembly comprising a first shield and a second shield wherein the first shield at least partially surrounds at least a pair of terminals and has a first shield contact at a first end and a second shield contact at a second end, and the second shield at least partially surrounds at least a further pair of terminals and has a first shield contact at a first end and second shield contact at a second end;

wherein the first carrier comprises a plurality of signal conductors and a plurality of substantially identical contact holes arranged adjacent each other in an array comprising at least one of a column and a row;

wherein the first and second shields are arranged adjacent each other so that the first shield contacts of each shield together fit and contact one common contact hole of the first carrier; and wherein the second shield contacts of each shield are arranged adjacent each other so that the second shield contacts of each shield are electrically connected by a second common contact site of a second carrier.

13. Connector comprising:

a plurality of terminals having terminal contacts, a first shield at least partially surrounding at least one first terminal and having a first shield contact at a first end and a second shield contact at a second end, and a second shield at least partially surrounding at least one first terminal and having a first shield contact at a first end and a second shield contact at a second end;

wherein the terminal contacts are configured to contact a number of the contact sites on a printed circuit board, wherein the first shield contacts of each shield are arranged adjacent each other so that they contact each other and together fit and are received into a common plated through hole on the printed circuit board; and wherein the second shield contacts of each shield are arranged adjacent each other so that they are electrically connected by a common contact site on a carrier.

14. Lead frame assembly for a connector of claim 13, comprising a dielectric carrier holding a plurality of terminals having substantially similar terminal contacts arranged generally in a column, and comprising:

a first shield at least partially surrounding at least one terminal and having a first shield contact; and a second shield at least partially surrounding at least one terminal and having a second shield contact;

wherein the first and second shield contacts are arranged adjacent each other and together form a combined contact which is substantially similar to the terminal contacts.

15. Lead frame assembly of claim 14, wherein the terminal contacts and the combined contact formed by the first and second shield contacts are arranged substantially equidistant.

* * * * *